US010294604B2

(12) United States Patent
Leibman

(10) Patent No.: US 10,294,604 B2
(45) Date of Patent: May 21, 2019

(54) DRYER APPLIANCE AND ADDITIVE DISPENSING ASSEMBLY

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 140 days.

(21) Appl. No.: 15/629,805

(22) Filed: Jun. 22, 2017

(65) Prior Publication Data

US 2018/0371679 A1 Dec. 27, 2018

(51) Int. Cl.

*D06F 58/20* (2006.01)
*D06F 58/28* (2006.01)
*D06F 60/00* (2009.01)

(52) U.S. Cl.

CPC ..... *D06F 58/203* (2013.01); *D06F 60/00* (2013.01); *D06F 2058/2854* (2013.01)

(58) Field of Classification Search

CPC . D06F 58/203; D06F 60/00; D06F 2058/2854
USPC ..... 34/597
See application file for complete search history.

(56) References Cited

U.S. PATENT DOCUMENTS 2,677,389 A 5/1954 Jisha et al.
4,207,683 A 6/1980 Horton
6,584,633 B2 7/2003 Chute et al.
7,946,057 B2 * 5/2011 Dittmer ..... D06F 58/20 34/597
7,954,344 B2 * 6/2011 Kim ..... F22B 1/284 34/77
8,104,191 B2 * 1/2012 Ricklefs ..... D06F 58/203 34/474
8,166,591 B2 5/2012 Dunn et al.
8,256,136 B2 * 9/2012 Bae ..... D06F 58/203 34/407
8,695,232 B2 * 4/2014 Choi ..... D06F 58/203 34/597
8,819,959 B2 * 9/2014 Klug ..... D06F 39/022 137/177
8,850,856 B2 10/2014 Leibman et al.
(Continued)

FOREIGN PATENT DOCUMENTS

EP 2145998 A1 * 1/2010 ..... D06F 58/203
EP 2902540 A1 8/2015
KR 20100009042 A * 1/2010 ..... D06F 58/203

*Primary Examiner* — Stephen M Gravini
(74) *Attorney, Agent, or Firm* — Dority & Manning, P.A.

(57) ABSTRACT

A dryer appliance and additive dispensing assembly is generally provided herein. The additive dispensing assembly may be positioned within the cabinet and configured to provide an additive mist to the drum. The additive dispensing assembly may include a supply conduit, an additive dispenser, and a siphon channel. The supply conduit may extend between a fluid supply and the drum. The additive dispenser may store and dispense a dryer additive. The siphon channel may extend from the additive dispenser to the supply conduit downstream from the fluid supply. An initial flow of fluid directed through the supply conduit may create a siphon that draws the dryer additive into the supply conduit to mix with the flow of fluid and create an additive flow that is dispensed into the drum.

18 Claims, 5 Drawing Sheets

(56) References Cited

U.S. PATENT DOCUMENTS

| | | | | |
|---|---|---|---|---|
| 9,046,071 | B2 | 6/2015 | Portolan et al. | |
| 9,051,676 | B2 | 6/2015 | Leibman et al. | |
| 9,217,219 | B2 | 12/2015 | Hanau et al. | |
| 9,267,229 | B2 * | 2/2016 | Oh | D06F 25/00 |
| 9,493,901 | B2 * | 11/2016 | Bolduan | D06F 39/02 |
| 9,951,460 | B2 * | 4/2018 | Boulduan | D06F 39/022 |
| 2010/0011611 | A1 | 1/2010 | Kim et al. | |
| 2012/0131811 | A1 * | 5/2012 | Del Pos | D06F 58/18 34/73 |
| 2012/0159800 | A1 * | 6/2012 | Del Pos | D06F 58/04 34/74 |
| 2014/0352364 | A1 | 12/2014 | Martinez Villarreal | |
| 2014/0373284 | A1 | 12/2014 | Leibman et al. | |
| 2015/0192030 | A1 | 7/2015 | Rubinshtein et al. | |
| 2018/0371679 | A1 * | 12/2018 | Leibman | D06F 58/203 |

* cited by examiner

DRYER APPLIANCE AND ADDITIVE DISPENSING ASSEMBLY

FIELD OF THE INVENTION

The present subject matter relates generally to dryer appliances, and more particularly to and more particularly to additive dispensers for dryer appliances.

BACKGROUND OF THE INVENTION

Dryer appliances generally include a cabinet with a drum mounted therein. In some dryer appliances, a motor rotates the drum during operation of the dryer appliance, e.g., to tumble articles located within a chamber defined by the drum. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In some instances, it may be desirable to provide certain objects or fluids for the treatment of articles within a dryer appliance. For instance, dryer sheets are commonly placed within the drum of a dryer appliance to affect the smell of the fabrics or clothes being treated (i.e., tumbled and/or dried) in a specific laundry load. In other instances, a wrinkle release fluid (e.g., fluids comprising fabric relaxer, fabric softener, isopropyl alcohol, vinegar, etc.) may be applied to sprayed on articles by a user before or after the articles are treated by the dryer appliance. In still other instances a UV fabric protector (e.g., fluids comprising titanium oxide, bemotrizinol, etc.) to absorb or repel ultraviolet light emissions may be sprayed on articles by a user before or after the articles are treated by the dryer appliance. However, difficulties exist with such approaches. Specifically, a user must generally remember to supply a specific object or fluid to each individual drying load. Moreover, in many cases a user must estimate or guess how much of the specific object or fluid is appropriate for an individual load. Although some existing dryer appliances provide for automatically (e.g., without direct user input) supplying steam to individual dryer loads, existing dryer appliances are generally unable to automatically supply specific dryer additives to articles therein.

Accordingly, a dryer appliance having an additive dispensing assembly for delivering certain additives affecting the smell and/or performance of fabrics would be desirable. More particularly, an additive dispensing assembly that provides a suitable additive volume load across a range of applications would be especially desirable.

BRIEF DESCRIPTION OF THE INVENTION

Aspects and advantages of the invention will be set forth in part in the following description, or may be obvious from the description, or may be learned through practice of the invention.

In one aspect of the present disclosure a dryer appliance is provided. The dryer appliance may include a cabinet, a drum, and an additive dispensing assembly. The drum may be rotatably mounted within the cabinet. Moreover, the drum may define a space for the receipt of clothes for drying. The additive dispensing assembly may be positioned within the cabinet and configured to provide an additive mist to the drum. The additive dispensing assembly may include a supply conduit, an additive dispenser, and a siphon channel.

The supply conduit may extend between a fluid supply and the drum. The additive dispenser may store and dispense a dryer additive. The siphon channel may extend from the additive dispenser to the supply conduit downstream from the fluid supply, wherein an initial flow of fluid directed through the supply conduit creates a siphon that draws the dryer additive into the supply conduit to mix with the flow of fluid and create an additive flow that is dispensed into the drum.

In another aspect of the present disclosure an additive dispensing assembly for providing an additive mist to a drum of a dryer appliance is provided. The additive dispensing assembly may include a supply conduit, an additive dispenser, a siphon channel, and a misting assembly. The supply conduit may extend between a fluid supply and the drum. The additive dispenser may store and dispense a dryer additive. The siphon channel may be operably couple the additive dispenser to the supply conduit downstream from the fluid supply such that an initial flow of fluid directed through the supply conduit creates a siphon that draws the dryer additive into the supply conduit to mix with the flow of fluid and create an additive flow. The misting assembly may be in operable communication with the supply conduit to vaporize the additive flow to the additive mist that is dispensed into the drum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
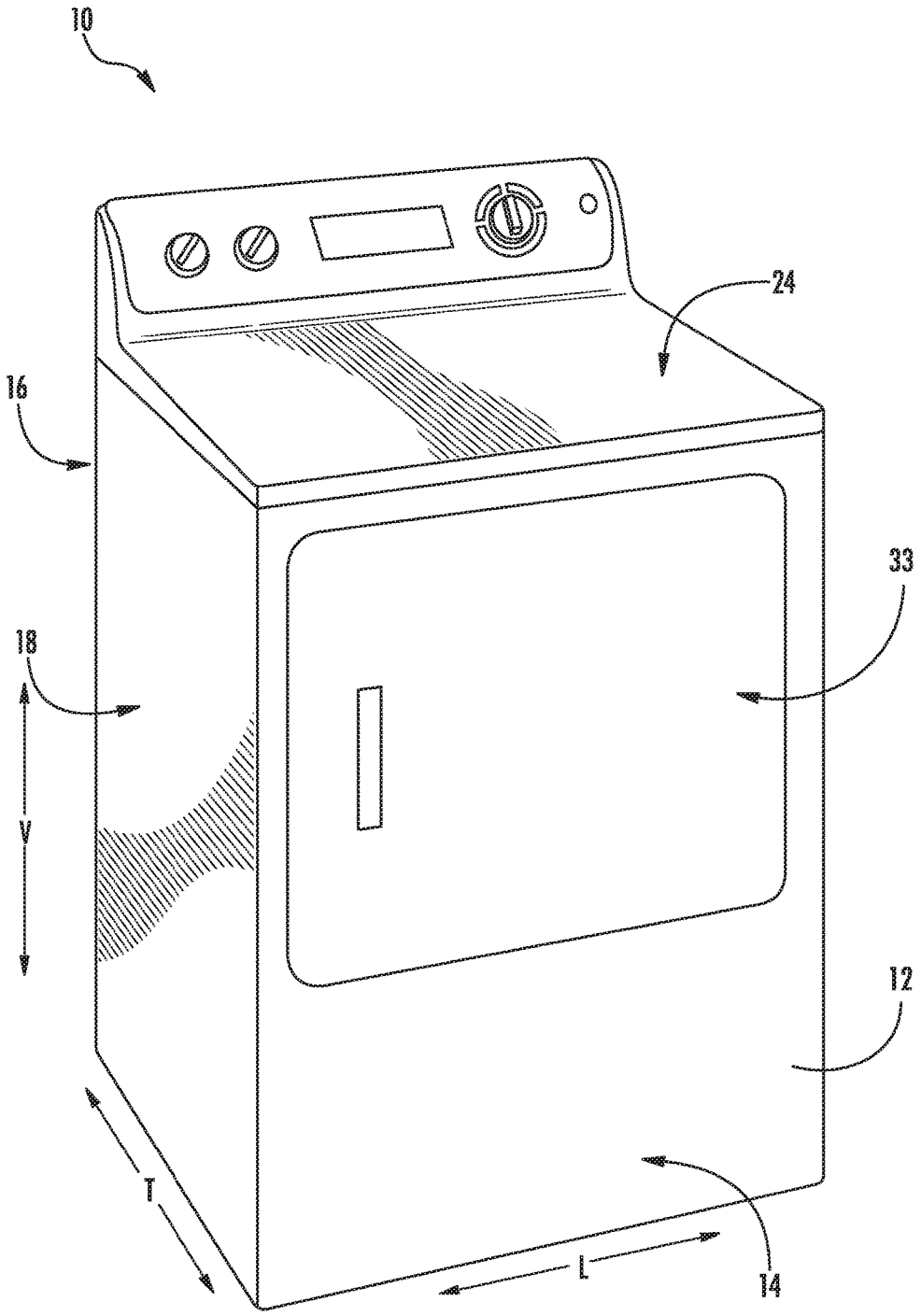
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
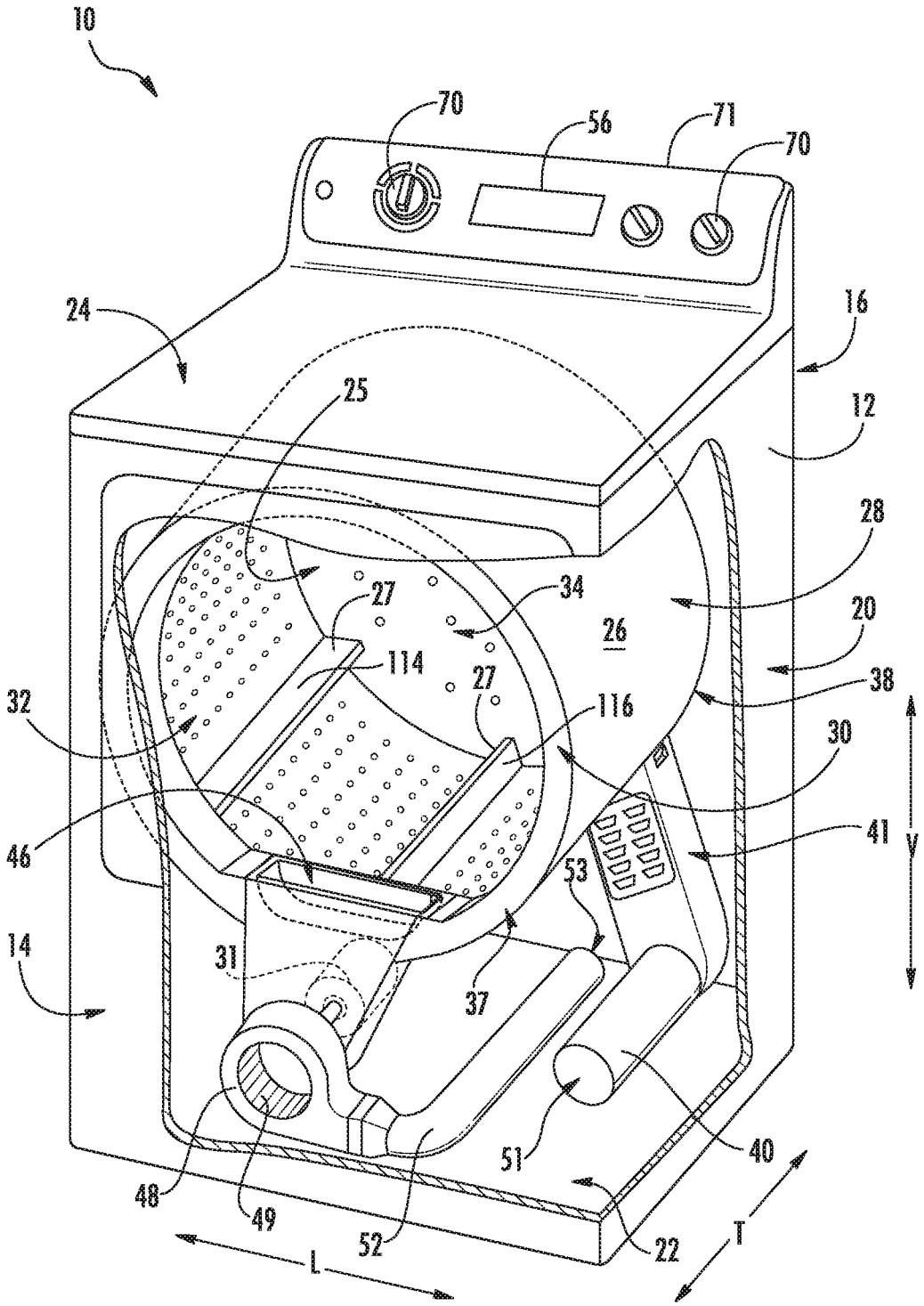
FIG. 2 provides a perspective view of the exemplary dryer appliance of FIG. 1 with portions of a cabinet of the dryer appliance removed to reveal certain components of the dryer appliance.

Turning now to the figures, FIG. 1 provides dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 is mounted to rear wall 34 and receives heated air that has been heated by a heating assembly or system 40.

As used herein, the term "clothing" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles (e.g., baffles 27) are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Motor 31 may also be in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative exemplary embodiments, dryer appliance 10 may include an additional motor (not shown) for rotating fan 49 of air handler 48 independently of drum 26.

Drum 26 is generally configured to receive heated air that has been heated by a heating assembly 40, e.g., in order to dry damp articles disposed within chamber 25 of drum 26. For example, heating assembly 40 may include a heating element (not shown), such as a gas burner, an electrical resistance heating element, or heat pump, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture saturated air through a screen filter (not shown) which traps lint particles. Such moisture statured air then enters an exit duct 46 and is passed through air handler 48 to an exhaust duct 52. From exhaust duct 52, such moisture statured air passes out of dryer appliance 10 through a vent 53 defined by cabinet 12. After the clothing articles have been dried, they may be removed from the drum 26 via opening 32. A door 33 mounted to cabinet 12 provides for closing or accessing drum 26 through opening 32.

One or more selector inputs 70, such as knobs, buttons, touchscreen interfaces, etc., may be provided or mounted on a cabinet backsplash 71 and is in operable communication (e.g., electrically coupled or coupled through a wireless network band) with a processing device or controller 56. Signals generated in controller 56 direct operation of motor 31 and heating assembly 40 in response to the position of selector knobs 70. Alternatively, a touch screen type interface may be provided. As used herein, "processing device" or "controller" may refer to one or more microprocessors, microcontroller, ASICS, or semiconductor devices and is not restricted necessarily to a single element. The controller 56 may be programmed to operate dryer appliance 10 by executing non-transitory instructions stored in memory. The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations.

Figure 3:
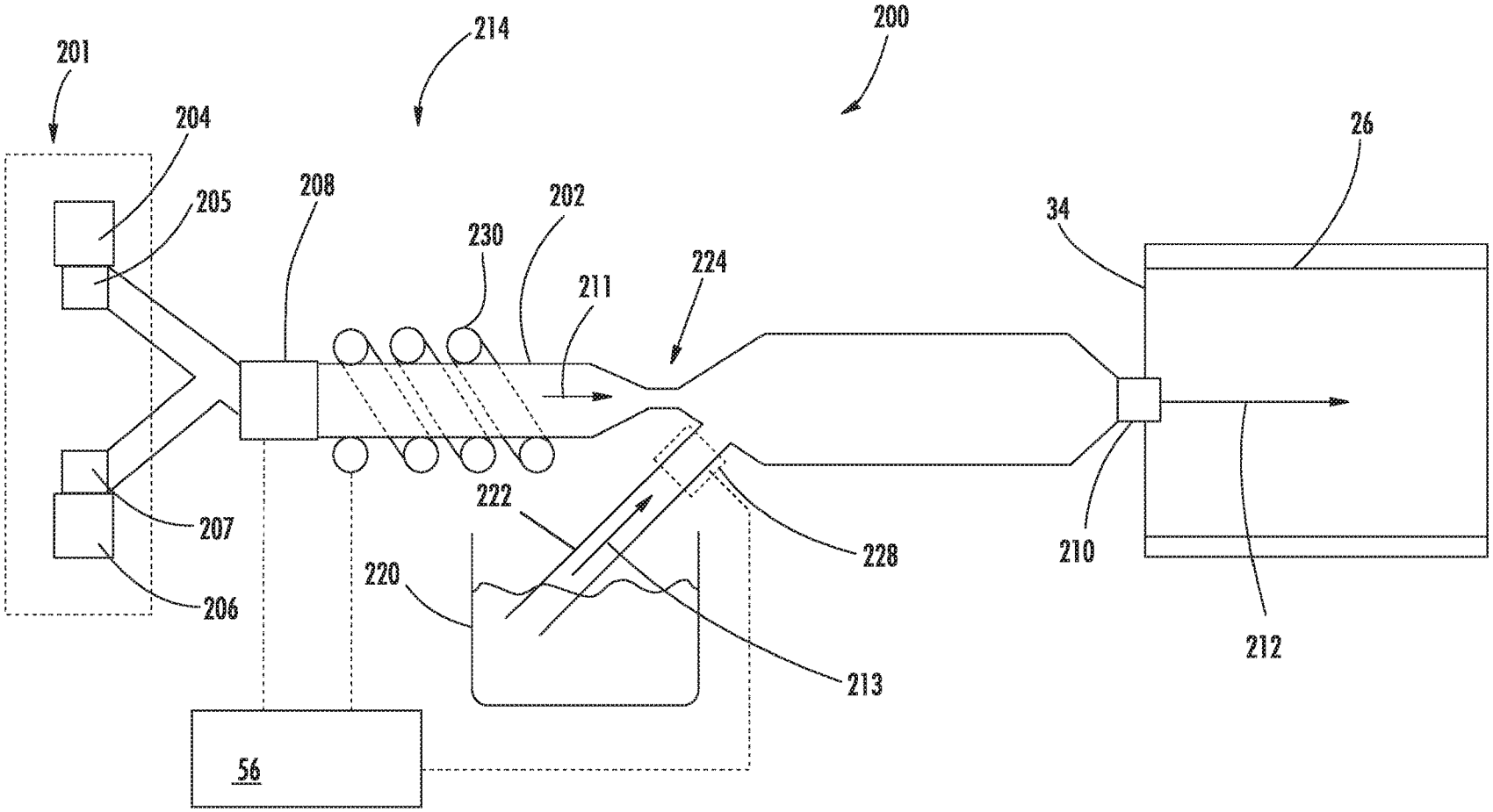
FIG. 3 provides a schematic view of an additive dispensing assembly according to exemplary embodiments of the present disclosure.
Figure 4:
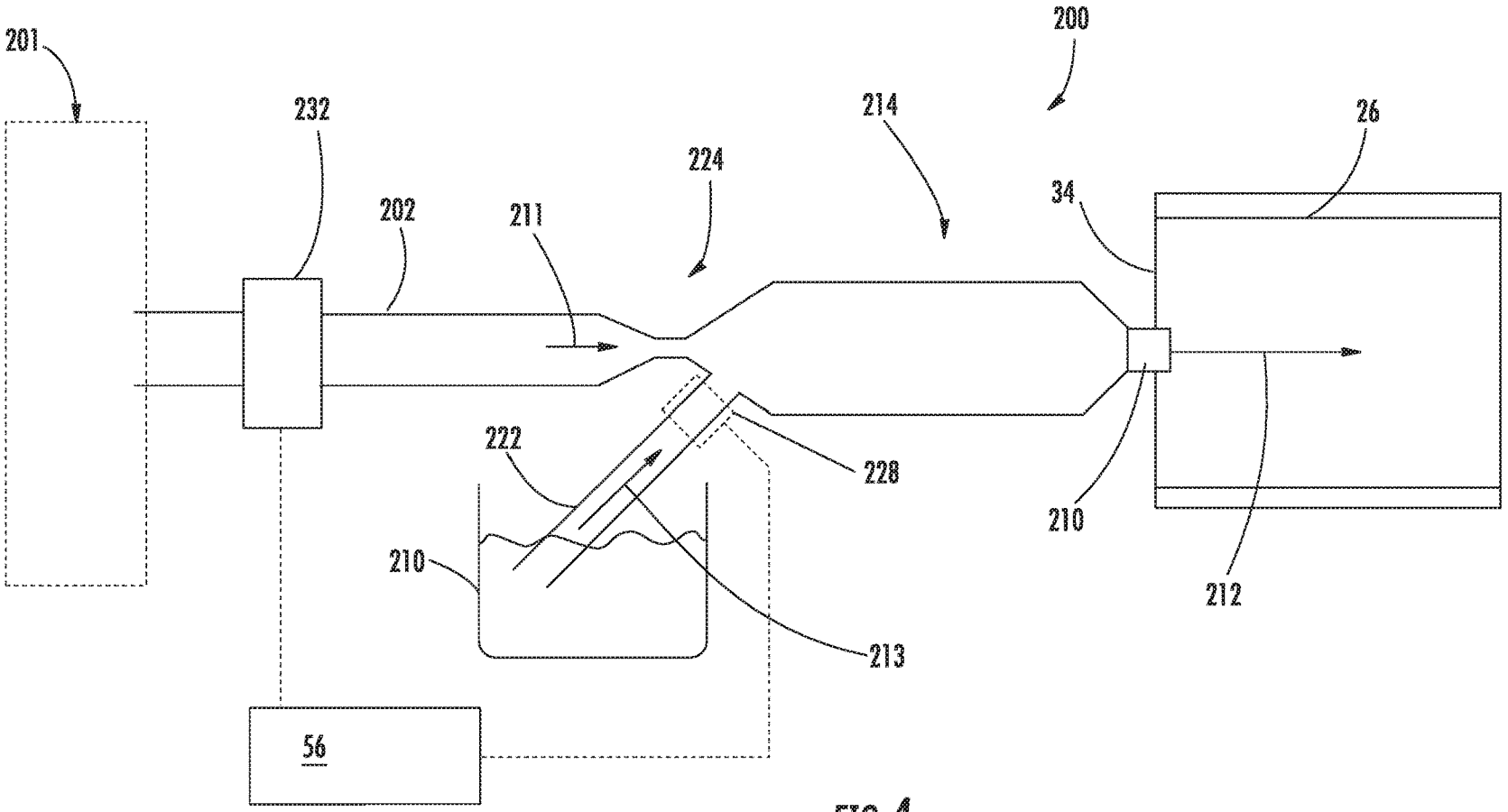
FIG. 4 provides a schematic view of an additive dispensing assembly according to exemplary embodiments of the present disclosure.
Figure 5:
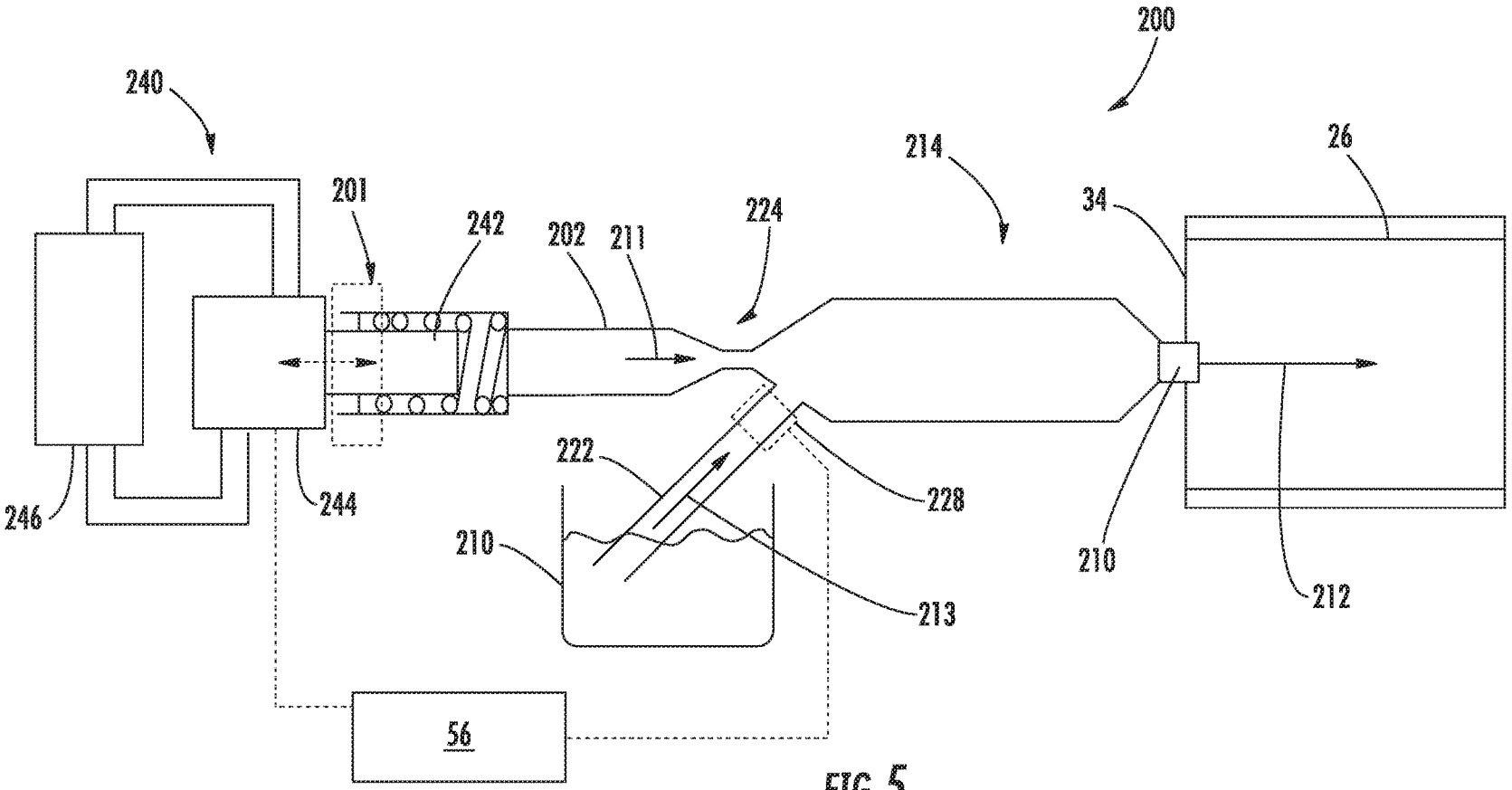
FIG. 5 provides a schematic view of an additive dispensing assembly according to exemplary embodiments of the present disclosure.

Referring now to FIGS. 3 through 5, an additive dispensing assembly 200 for an appliance, such as dryer appliance 10, will be described in more detail. Although the discussion below refers to additive dispensing assembly 200, one skilled in the art will appreciate that the features and configurations described may be used for other additive dispensers in other dryer appliances as well. For example, additive dispensing assembly 200 may be positioned elsewhere within cabinet 12; may have a different components or configurations; and may dispense water, detergent, or other additives. It is understood that other variations and modifications of the exemplary embodiments described below are possible, and such variations are contemplated as within the scope of the present subject matter.

According to an exemplary embodiment, additive dispensing assembly 200 may be mounted within cabinet 12 using a plurality of mounting features or mechanical fasteners. Additionally or alternatively, adhesive(s), snap-fit mechanisms, interference-fit mechanisms, or any suitable combination thereof may secure additive dispensing assembly 200 to cabinet 12. One skilled in the art will appreciate that additive dispensing assembly 200 may be mounted in other locations and use other mounting means according to alternative embodiments.

Referring now specifically to FIG. 3, an exemplary embodiment of additive dispensing assembly 200 will be described in detail. As shown, a fluid, such as water, is provided through a supply conduit 202. In turn, supply conduit 202 may receive an initial fluid flow (represented by the arrow 211) from a fluid supply 201. As an example, hot and/or cold water may be provided from a hot water inlet 204 and a cold water inlet 206, respectively. Hot water inlet 204 may be provided on or at a hot water supply, such as a domestic or commercial hot water tank. Cold water inlet 206 may be provided on or at a cold water supply, such as a well or municipal water-supply network.

In order to dispense fluid at the desired temperature, hot and cold water may be selectively dispensed in ratios that produce the desired water temperature. For example, the flow of hot water through hot water inlet 204 may be selectively adjusted using a hot water solenoid valve 205. Moreover, the flow of cold water through cold water inlet 206 may be selectively adjusted using a cold water solenoid valve 207. In some embodiments, controller 56 is in operable communication (e.g., electrically coupled or coupled through a wireless network band) to one or more of solenoid valves 205, 207. According to one or more operating conditions, the flow of water through one or both of hot water solenoid valve 205 or cold water inlet 206 may be increased or decreased (e.g., as directed by controller 56).

In additional or alternative embodiments, a diverter or supply valve 208 is fluidly connected to (e.g., in fluid communication with) hot water inlet 204 and cold water inlet 206. Supply valve 208 may be positioned downstream from inlets 204, 206 and upstream from water supply conduit 202. During operation, supply valve 208 may selectively permit water (e.g., a mixture of hot water and cold water) into supply conduit 202. Optionally, supply valve 208 may be a solenoid valve. In some embodiments, controller 56 is in operable communication (e.g., electrically coupled or coupled through a wireless network band) with supply valve 208 to control or direct the amount of water permitted through supply valve 208.

As illustrated, supply conduit 202 may extend to (e.g., terminate at) drum 26. Generally, supply conduit 202 may connect to drum 26 in any manner suitable for dispensing water and/or dryer additive into drum 26 as a misted flow (represented by the arrow 212). According to the illustrated embodiment, supply conduit 202 is fluidly connected to drum 26 through a dispensing nozzle 210. In some such embodiments, dispensing nozzle 210 has a tapered or narrowed diameter from supply conduit 202.

In some embodiments, a misting assembly 214 is provided in operable communication (e.g., fluid communication or mechanical communication) with supply conduit 202 (e.g., to affect the flow of fluid therein). Generally, misting assembly 214 includes one or more features for vaporizing a fluid flow through and/or from supply conduit 202. For instance, misting assembly 214 may include a heater 230 (e.g., electrical resistance heating element, radiant heater, gas burner, etc.). Generally, heater 230 is positioned in thermal communication with supply conduit 202.

In certain embodiments, heater 230 is positioned about and/or on supply conduit 202. As illustrated in FIG. 3, heater 230 may be coiled about an outer surface of supply conduit 202 in fluid isolation from a water supply. Additionally or alternatively, heater 230 may be positioned upstream from the siphon channel of additive supply conduit 222. Moreover, heater 230 may be in operable communication (e.g., electrically coupled or coupled through a wireless network band) with controller 56. During operations, controller 56 may selectively activate heater 230 to direct heat to the initial flow 211 (e.g., water) passing through supply conduit 202. In turn, water flowing through supply conduit 202 may transition to a steam or steam mixture flow upon receiving heat from heater 230 before flowing to drum 26 (e.g., as a portion of an misted flow 212).

In additional or alternative embodiments, misting assembly 214 includes an atomizer nozzle. For instance, dispensing nozzle 210 downstream from the siphon channel of additive supply conduit 222 may be provided as an atomizer nozzle. Fluid flowing through supply conduit 202 may thus be directed into drum 26 as an atomized misted flow 212. The misted flow 212 may comprise an additive mist or, alternatively, be an injected mist substantially free of the dryer additive. Optionally, dispensing nozzle 210 may include a plurality of nozzles. For instance, a plurality of apertures or nozzles 210 may be positioned at rear wall 34 of drum 26.

In optional embodiments, a booster pump (not pictured), such as a positive displacement pump or centrifugal pump, may be provided along the supply conduit 202 (e.g., at or in place of valve 208) downstream from the fluid supply 201. In certain embodiments, booster pump 214 is positioned downstream from the fluid supply 201, e.g., in fluid communication therewith. During operations, the booster pump may thus operate to motivate fluid through supply conduit 202, e.g., from inlets 204, 206 to drum 26.

Additive dispensing assembly 200 includes an additive dispenser 220, e.g., a reservoir for storing a liquid dryer additive. In this regard, additive dispenser 220 may be configured to receive one or more dryer additives. More particularly, according to an exemplary embodiment, additive dispenser 220 is a reservoir that is intended to store sufficient dryer additives for multiple cycles in order to avoid requiring the user to add a measured quantity of dryer additive prior to each dryer cycle. Optionally, the dryer additive may include a perfume material to provide a desirable smell or scent to a dry load. Additionally or alternatively, the dryer additive may include a UV fabric protector (e.g., a fluid comprising titanium oxide, bemotrizinol, etc.) to absorb or repel ultraviolet light emissions. Also additionally or alternatively, the dryer additive may include a wrinkle release fluid (e.g., a fluid comprising fabric relaxer, fabric softener, isopropyl alcohol, vinegar, etc.) to reduce or prevent wrinkles from forming on articles within a dry load. Moreover, it is noted that any other suitable dryer additive may be included.

Additive dispenser 220 is fluidly connected to (e.g., in fluid communication with) supply conduit 202 through an additive supply conduit 222. As illustrated, additive supply conduit 222 may define a siphon channel that draws in dryer additive (represented by the arrow 213) from additive dispenser 220 when water flows through supply conduit 202. More particularly, as water is supplied through supply conduit 202 as an initial flow 211, the flowing water creates a negative pressure within additive supply conduit 222. This negative pressure may draw in dryer additive 213 from additive dispenser 220, e.g., in proportion to the amount of water and/or steam flowing through supply conduit 202 as part of the initial flow 211. Additive supply conduit 222 may be calibrated according to a desired amount of dryer additive. For instance, the siphon channel of additive supply conduit 222 may be sized and shaped to provide a selected flow rate, e.g., volumetric flow rate, of the dryer additive 213. The selected flow rate of the dryer additive 213 may be set according to the initial fluid flow 211, a predetermined flow rate, and/or pressure through the supply conduit 202. During operation, the selected flow rate of the dryer additive 213 may be proportional to the predetermined flow rate of fluid through the supply conduit 202.

In optional embodiments, additive dispensing assembly 200 further includes a valve 228 configured to control the flow of dryer additive through additive supply conduit 222. For example, valve 228 may be a solenoid valve that is in operable communication (e.g., electrically coupled or coupled through a wireless network band) to controller 56. Controller 56 may selectively open and close valve 228 to allow dryer additive to flow from additive dispenser 220 through additive supply conduit 222. During certain operations, controller 56 may direct valve 228 to close such that water and/or steam may be directed to drum 26 without the addition of dryer additive.

As shown in FIG. 3, additive supply conduit 222 may be fluidly connected to supply conduit 202 through a Venturi nozzle 224. Venturi nozzle 224 is positioned downstream from valve 208 and receives the siphon channel of additive supply conduit 222. The additive supply conduit 222 and Venturi nozzle 224 may be configured (e.g., sized and shaped) to ensure the desired amount of dryer additive is supplied for a given flow rate of the initial flow 211 through supply conduit 202. For example, by adjusting the diameter of the additive supply conduit 222 and the flow restriction of Venturi nozzle 224, the volumetric flow rate of dryer additive 213 may be adjusted.

According to the illustrated exemplary embodiments, supply conduit 202 is fluidly connected to drum 26 through dispensing nozzle 210, and additive supply conduit 222 is fluidly connected to supply conduit 202 through Venturi nozzle 224. As described above, nozzles 210, 224 may be shaped in a manner suitable for injecting fluid into drum 26 and dryer additive 213 into supply conduit 202, respectively.

As illustrated, additive supply conduit 222 is fluidly connected to (e.g., in fluid communication with) supply conduit 202 upstream of dispensing nozzle 210. In this manner, the initial fluid flow 211 may entrain, mix, and/or dissolve the dryer additive 213 prior to dispensing into drum 26 through dispensing nozzle 210. According to alternative embodiments, additive supply conduit 222 may be connected further upstream on supply conduit 202 or in a location where dryer additive 213 may dissolve more quickly, e.g., near hot water inlet 204. Optionally, heater 230 may further heat water through supply conduit 202 such that dryer additive 213 entrains with steam and/or water flowing to drum 26. Additionally or alternatively, dispensing nozzle 210 may include an atomizer nozzle to further disperse or atomize the fluid mixture flowing from supply conduit 202 as it enters drum 26.

As illustrated in FIG. 3, valve 208 may be in operable communication (e.g., electrically coupled or coupled through a wireless network band) with controller 56. During operations, controller 56 may selectively control valve 208 to direct or motivate fluid flowing through supply conduit 202 to drum 26. During operations of additive dispenser assembly 200, supply conduit 202 may thus receive the initial fluid flow 211 of water from fluid supply 201 as it is motivated through supply conduit 202 and to drum 26. As fluid flows, a dryer additive 213 from additive dispenser 220 may be added in proportion to the amount of fluid (e.g., steam and/or water) flowing through supply conduit 202. More specifically, water is initially provided from fluid supply 201 to achieve the desired flow rate. This flow rate may be controlled by controller 56 or may be manually adjusted by the user. Water flowing through the supply conduit 202 as an initial fluid flow 211, can create a negative pressure in additive supply conduit 222. This negative pressure draws in dryer additive 213 from additive dispenser 220. The dryer additive 213 travels through additive supply conduit 222 and is injected into dryer supply conduit 202 (e.g., by Venturi nozzle 224). The fluid traveling through supply conduit 202 mixes with the dryer additive 213. Notably, the concentration of dryer additive 213 within the delivered misted flow 212 may be proportional to the amount of steam and/or water delivered to drum 26.

Turning now to FIG. 4, another exemplary additive dispenser assembly 200 is illustrated. It is understood that, except as otherwise indicated, the embodiment of FIG. 4 is similar to the above-described embodiment of FIG. 3. Thus, similar reference numerals are used throughout. Moreover, it is understood that one or more features of the exemplary embodiment of FIG. 3 may be incorporated into alternative embodiments of the exemplary additive dispenser assembly 200 of FIG. 4, and vice versa.

As illustrated in FIG. 4, supply conduit 202 may be in fluid communication with a fluid supply 201 that is an air supply. For example, the air supply may be a vented region of the cabinet 12 or the ambient environment. Alternatively, the air supply may be a discrete enclosed and/or pressurized air tank (not pictured) storing compressed gas or air therein. In optional embodiments, an air handler 232, such as a fan or blower, is disposed in fluid communication between the air supply and the supply conduit 202 to motivate the initial fluid flow 211 through the supply conduit 202. As illustrated in FIG. 4, air handler 232 may be in operable communication (e.g., electrically coupled or coupled through a wireless network band) with controller 56. During operations, controller 56 may selectively activate air handler 232 to direct or motivate air flowing through supply conduit 202 to drum 26.

During operations of additive dispenser assembly 200, supply conduit 202 may thus receive air from fluid supply 201 as it is motivated through supply conduit 202 and to drum 26. As fluid flows, a dryer additive 213 from additive dispenser 220 may be added in proportion to the amount of fluid (e.g., air) flowing through supply conduit 202. More specifically, air is provided from fluid supply 201 (e.g., as motivated by air handler 232) to achieve the desired flow rate. This flow rate may be controlled by controller 56 or may be manually adjusted by the user. Air flowing through the supply conduit 202 as an initial fluid flow 211, can create a negative pressure in additive supply conduit 222. This negative pressure draws in dryer additive 213 from additive dispenser 220. The dryer additive 213 travels through additive supply conduit 222 and is injected into dryer supply conduit 202 (e.g., by Venturi nozzle 224). The fluid traveling through supply conduit 202 mixes with the dryer additive 213. Notably, the concentration of dryer additive 213 within the delivered misted flow 212 may be proportional to the amount of air delivered to drum 26.

Turning now to FIG. 5, another exemplary additive dispenser assembly 200 is illustrated. It is understood that, except as otherwise indicated, the embodiment of FIG. 5 is similar to the above-described embodiments of FIGS. 3 and 4. Thus, similar reference numerals are used throughout. Moreover, it is understood that one or more features of the exemplary embodiments of FIGS. 3 and 4 may be incorporated into alternative embodiments of the exemplary additive dispenser assembly 200 of FIG. 5, and vice versa.

As illustrated in FIG. 5, supply conduit 202 may be in fluid communication with a fluid supply 201 that is an air supply. For example, the air supply may be a vented region of the cabinet 12 or the ambient environment. Alternatively, the air supply may be a discrete enclosed and/or pressurized air tank (not pictured) storing compressed gas or air therein. In some embodiments, an hydraulic actuating assembly 240 is provided to selectively direct air (e.g., as an isolated plug) through supply conduit 202. For instance, a reciprocating piston 242 may be disposed in fluid communication between the fluid supply 201 and supply conduit 202. An actuating chamber 244 may receive and/or dispense hydraulic fluid (e.g., from/to an hydraulic fluid chamber 246) to control movement and positioning of piston 242. As piston 242 is selectively actuated or reciprocated toward supply conduit 202, piston 242 may motivate an initial fluid flow 211 (e.g., as an isolated plug of air) through supply conduit 202. As illustrated in FIG. 5, hydraulic actuating assembly 240 may be in operable communication (e.g., electrically coupled or coupled through a wireless network band) with controller 56. During operations, controller 56 may selectively actuate piston 242 to motivate air flowing through supply conduit 202 to drum 26.

During operations of additive dispenser assembly 200, supply conduit 202 may thus receive air (e.g., as an isolated plug) from fluid supply 201 as it is motivated through supply conduit 202 and to drum 26 by piston 242. As air flows, a dryer additive 213 from additive dispenser 220 may be added in proportion to the amount of air flowing through supply conduit 202. More specifically, piston 242 is actuated, motivating air from fluid supply 201 to achieve the desired flow rate. This flow rate may be controlled by controller 56 or may be manually adjusted by the user. Air flowing into the supply conduit 202 as an initial fluid flow 211, can create a negative pressure in additive supply conduit 222. This negative pressure draws in dryer additive 213 from additive dispenser 220. The dryer additive 213 travels through additive supply conduit 222 and is injected into dryer supply conduit 202 (e.g., by Venturi nozzle 224). The air traveling through supply conduit 202 mixes with the dryer additive 213. Notably, the concentration of dryer additive 213 within the delivered misted flow 212 may be proportional to the amount of air delivered to drum 26. Moreover, a precise amount of additive dispensed into drum 213 may be determined according to the number of air plugs motivated by hydraulic actuating assembly 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a space for the receipt of clothes for drying; and an additive dispensing assembly positioned within the cabinet and configured to provide an additive mist to the drum, the additive dispensing assembly comprising a supply conduit extending between a fluid supply and the drum, an additive dispenser for storing and dispensing a dryer additive, and a siphon channel extending from the additive dispenser to the supply conduit downstream from the fluid supply, wherein an initial flow of fluid directed through the supply conduit creates a siphon that draws the dryer additive into the supply conduit to mix with the flow of fluid and create an additive flow that is dispensed into the drum.

2. The dryer appliance of claim 1, wherein the fluid supply is an air supply, and wherein the additive dispensing assembly further comprises an air handler in fluid communication between the air supply and the supply conduit to motivate the initial fluid flow through the supply conduit.

3. The dryer appliance of claim 1, wherein the additive dispensing assembly further comprises a piston in fluid communication between the fluid supply and the supply conduit to motivate the initial fluid flow through the supply conduit.

4. The dryer appliance of claim 1, wherein the fluid supply is a water supply.

5. The dryer appliance of claim 1, further comprising a heater positioned in thermal communication with the supply conduit upstream from the siphon channel.

6. The dryer appliance of claim 1, further comprising an atomizer nozzle positioned in fluid communication between the supply conduit and the drum, the atomizer nozzle being downstream from the siphon channel.

7. The dryer appliance of claim 1, wherein the supply conduit includes a Venturi nozzle downstream from the fluid supply to receive the siphon channel.

8. The dryer appliance of claim 1, wherein the dryer additive comprises a perfume, a UV fabric protector, or a wrinkle release fluid.

9. The dryer appliance of claim 1, further comprising a controller configured to selectively direct the initial flow of fluid.

10. An additive dispensing assembly for providing an additive mist to a drum of a dryer appliance, the additive dispensing assembly comprising a supply conduit extending between a fluid supply and the drum, an additive dispenser for storing and dispensing a dryer additive, and a siphon channel operably coupling the additive dispenser to the supply conduit downstream from the fluid supply such that an initial flow of fluid directed through the supply conduit creates a siphon that draws the dryer additive into the supply conduit to mix with the flow of fluid and create an additive flow, and a misting assembly in operable communication with the supply conduit to vaporize the additive flow to the additive mist that is dispensed into the drum.

11. The additive dispensing assembly of claim 10, wherein the fluid supply is an air supply, and wherein the additive dispensing assembly further comprises an air handler in fluid communication between the air supply and the supply conduit to motivate the initial fluid flow through the supply conduit.

12. The additive dispensing assembly of claim 10, further comprising a piston in fluid communication between the fluid supply and the supply conduit to motivate the initial fluid flow through the supply conduit.

13. The additive dispensing assembly of claim 10, wherein the fluid supply is a water supply.

14. The additive dispensing assembly of claim 10, wherein the misting assembly comprises a heater positioned in thermal communication with the supply conduit upstream from the siphon channel.

15. The additive dispensing assembly of claim 10, wherein the misting assembly comprises an atomizer nozzle positioned in fluid communication between the supply conduit and the drum, the atomizer nozzle being downstream from the siphon channel.

16. The additive dispensing assembly of claim 10, wherein the supply conduit includes a Venturi nozzle downstream from the fluid supply to receive the siphon channel.

17. The additive dispensing assembly of claim 10, wherein the dryer additive comprises a perfume, a UV fabric protector, or a wrinkle release fluid.

18. The additive dispensing assembly of claim 10, further comprising a controller configured to selectively direct the initial flow of fluid.

* * * * *